US005788613A

United States Patent [19]

Grimaldi

[11] Patent Number: 5,788,613

[45] Date of Patent: Aug. 4, 1998

[54] PORTABLE ADJUSTABLE BOXING SPEED BAG

[76] Inventor: John Grimaldi, 8740 SW. 21st St., Ft. Lauderdale, Fla. 33324

[21] Appl. No.: 904,786

[22] Filed: Aug. 1, 1997

[51] Int. Cl.[6] ..... A63B 21/00

[52] U.S. Cl. ..... 482/83; 482/87; 482/90; 473/441

[58] Field of Search ..... 482/83–90; 473/441–444, 473/445

[56] References Cited

U.S. PATENT DOCUMENTS

| | | | |
|---|---|---|---|
| 3,030,109 | 4/1962 | Albitz | 482/88 |
| 4,572,504 | 2/1986 | DiBartolo | 482/83 |
| 5,281,191 | 1/1994 | DeSoussa | 482/83 |
| 5,484,364 | 1/1996 | Boxing | 482/83 |
| 5,674,157 | 10/1997 | Wilkinson | 482/83 |

FOREIGN PATENT DOCUMENTS

| | | | |
|---|---|---|---|
| 0007496 | of 1910 | United Kingdom | 482/86 |

*Primary Examiner*—Jerome W. Donnelly
*Attorney, Agent, or Firm*—Law Practice of Scott L. Lampert, PA.; Scott L. Lampert

[57] ABSTRACT

A portable and adjustable boxing speed bag apparatus comprising a hollow base having a chamber defined by a top wall and surrounding side walls and sized to fit over and accept a structure therein, first and second generally U-shaped support brackets mounted to the side walls of the base so that the first and second ends of the first bracket are aligned in vertical relation with each other and the first and second ends of the second bracket are aligned in vertical relation with each other, a punching bag, a generally flat mounting surface secured to the first and second brackets so that the mounting surface lies in a generally horizontal orientation when the structure is seated within the chamber, a generally S-shaped hook having an upper end zone attached to the mounting surface and an opposite lower end zone attached to the punching bag, and at least one strap for securing the base to a structure, such as a boxing heavy bag. The apparatus may be adjusted to accommodate boxers of different heights by including a cord attached to opposite side walls of the base and stretching across the chamber. The cord is structured and disposed to prevent the structure from being fully inserted into the chamber, thereby raising the base and the attached punching bag. The apparatus may also include means for skewing the punching bag so that the punching bag will respond in an unpredictable manner upon being struck by a user.

19 Claims, 3 Drawing Sheets

PORTABLE ADJUSTABLE BOXING SPEED BAG

BACKGROUND OF THE INVENTION

1. Field of the Invention

The present invention relates to boxing apparatus and, more particularly, to a boxing speed bag which is portable and adjustable.

2. Description of the Related Art

Speed bags are commonly used by boxers as a training apparatus and by others as a source of exercise or hand-eye coordination enhancement. The existing speed bag art requires the mounting of a base to a ceiling or wall by bolts or other similar securement means or to another structure which is similarly bolted to a ceiling or wall. Mounting such a structure is cumbersome and difficult because the structure must be held in place against the ceiling or wall in order to be mounted. Due to the size, shape and weight of these existing speed bags, it is virtually impossible for a person to accomplish such a task without the help of others.

Furthermore, bolting the speed bag structure to a ceiling or wall essentially renders the speed bag structure a permanent fixture. Although it is possible to remove the speed bag structure from the ceiling or wall by removing the bolts, such a task is also cumbersome and difficult because, as in mounting the structure, it must be held in place against the ceiling or wall to avoid having the structure fall upon removal of the bolts, thereby damaging the speed bag structure, the floor or other object upon which it may fall or injuring the person removing the structure or other person in the vicinity. Additionally, removal of the speed bag structure from a ceiling or wall will leave a number of holes in the ceiling or wall.

Another problem with the existing art is its failure to easily adapt to boxers of different heights. Ideally, the speed bag should be situated at approximately the boxer's head height. However, the typical speed bag structure does not easily provide for height adjustments. Thus, boxers often are forced to utilize the speed bag at undesired heights.

In use, the speed bag is struck by the boxer causing the bag to strike an overhead plate or disk and bounce back to its initial vertical position. The boxer may then strike the bag again as it returns to its initial vertical position. Because the boxer will always know precisely where the bag will return, he is able to form a rhythm and repeatedly strike the bag without its stopping. This process, however, does not provide the boxer with practical experience because it is repetitive and, therefore, predictable and does not simulate the unpredictable actions and reactions of an opponent.

One device developed to address this problem is disclosed in U.S. Pat. No. 5,046,724. This device includes oppositely situated, outwardly extending punching bags mounted to a flexible post. The post is mounted to the floor. This device is designed for a boxer to strike one of the outwardly extending bags, thereby causing the post and the oppositely situated, outwardly extending bag to move in an unpredictable manner. A second boxer, on the opposite side of the post from the first boxer, in turn, strikes the outwardly extending bag on his side of the post causing the post and the oppositely situated, outwardly extending bag to likewise move in an unpredictable manner. However, this device requires two boxers and is fixedly attached to the floor. Thus, it cannot be utilized by a single person, is not portable and will leave holes in the floor if it is removed.

Accordingly, there is still a need in the art for a speed bag apparatus which is portable and, consequently, does not require bolting to a ceiling or wall, which may be easily installed by one person, which may be easily adjusted to accommodate boxers of different heights, and which may be set to provide for predictable or unpredictable responses.

SUMMARY OF THE INVENTION

The present invention is directed towards a new and improved portable and adjustable boxing speed bag apparatus comprising a hollow base, a first and second generally U-shaped support bracket, a punching bag, a generally flat mounting surface, a generally S-shaped hook having an upper end zone attached to the mounting surface and an opposite lower end zone attached to the punching bag, and at least one strap for securing the base to a structure, such as a boxing heavy bag. The base includes a top wall, surrounding side walls, and a chamber defined by the top wall and side walls. The chamber is sized to fit over and accept the structure therein. The first and second brackets each include a first end and an opposite second end. The first and second ends of the first and second brackets are mounted to the side walls of the base so that the first and second ends of the first bracket are aligned in vertical relation with each other and the first and second ends of the second bracket are aligned in vertical relation with each other. The mounting surface is secured to the first and second brackets so that the mounting surface lies in a generally horizontal orientation when the structure is seated within the chamber. Each strap includes a first end attached to a side wall of the base and an opposite second end attached to a side wall of the base opposite the side wall to which the first end of the strap is attached. Each strap is structured and disposed to snugly wrap around the structure, thereby securing the base to the structure. The apparatus may also be adjusted to accommodate boxers of different heights by including a cord attached to opposite side walls of the base and stretching across the chamber. The cord is structured and disposed to prevent the structure from being fully inserted into the chamber, thereby raising the base and the attached punching bag. The apparatus may also include means for skewing the punching bag so that the punching bag will respond in an unpredictable manner upon being struck by a user. The skewing means includes a generally cup-shaped member having a top face with skewed attachment means disposed at an off-center location and an opposite bottom face with non-skewed attachment means disposed centrally, whereby attachment of the skewed attachment means on the top face to the mounting surface and the punching bag to the non-skewed attachment means on the bottom face causes the punching bag to respond in an unpredictable manner upon being struck by a user, and whereby attachment of the non-skewed attachment means on the bottom face to the mounting surface and the punching bag to the skewed attachment means on the top face causes the punching bag to respond in a predictable manner upon being struck by a user.

It is an object of the present invention to provide a new and improved boxing speed bag apparatus which is portable.

It is another object of the present invention to provide a boxing speed bag apparatus which may be easily adjusted to accommodate boxers of different heights.

It is also an object of the present invention to provide a boxing speed bag apparatus which may be easily installed by one person.

It is yet another object of the present invention to provide a boxing speed bag apparatus which may be for set to provide for predictable or unpredictable responses.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Figure 1:
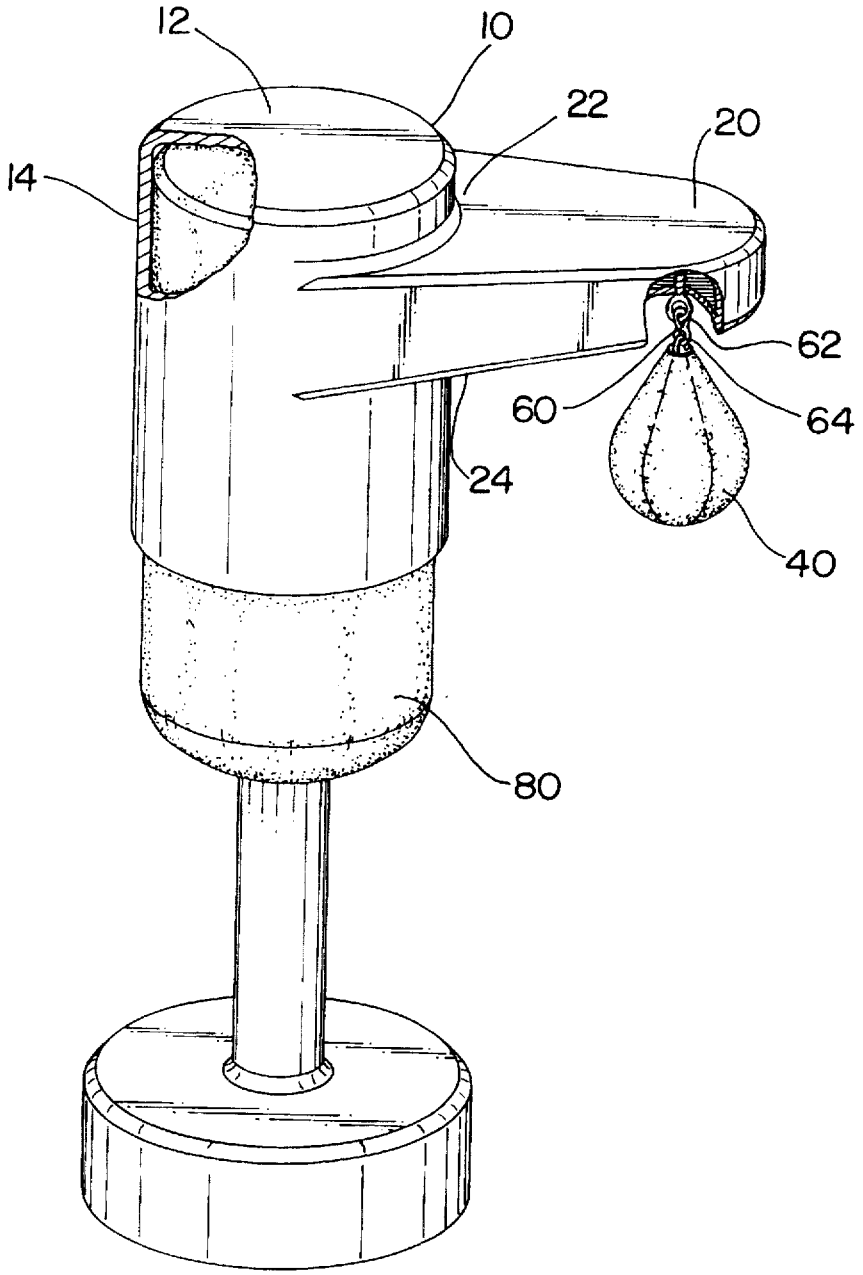
FIG. 1 is a side view of the present invention in partial section showing the base mounted on a boxing heavy bag.

As shown in FIGS. 1–5, the present invention is directed towards a new and improved portable and adjustable boxing speed bag apparatus comprising a hollow base 10, a first 20 and second 30 generally U-shaped support bracket, a punching bag 40, a generally flat mounting surface 50, a generally S-shaped hook 60 having an upper end zone 62 attached to the mounting surface 50 and an opposite lower end zone 64 attached to the punching bag 40, and at least one strap 70 for securing the base 10 to a structure 80, such as a boxing heavy bag. The base 10 includes a top wall 12, surrounding side walls 14, and a chamber 16 defined by the top wall 12 and side walls 14. The chamber 16 is sized to fit over and accept the structure 80 therein. The base 10 may be constructed of plastic or any other suitable material.

The first 20 and second 30 brackets each include a first end 22, 32 and an opposite second end 24, 34. The first 22, 32 and second 24, 34 ends of the first 20 and second 30 brackets are fixedly attached to the side walls 14 of the base 10 and disposed so that the first 22 and second 24 ends of the first bracket 20 are aligned in vertical relation with each other, the first 32 and second 34 ends of the second bracket 30 are aligned in vertical relation with each other, the first ends 22, 32 of the first 20 and second 30 brackets are aligned in horizontal relation with each other and the second ends 24, 34 of the first 20 and second 30 brackets are aligned in horizontal relation with each other. The first 20 and second 30 brackets may be constructed of hardened plastic, metal or any other suitable material capable of withstanding the shock of the blows to the punching bag 40. The first 20 and second 30 brackets may be attached to the side wall 14 of the base 10 by screws or any other suitable securement means.

The mounting surface 50 is secured to the first 20 and second brackets 30 so that the mounting surface 50 lies in a generally horizontal orientation when the structure 80 is seated within the chamber 16. The mounting surface 50 is preferably circular, but may be of any other suitable shape capable of bouncing the punching bag 40 back towards its original position after being struck by a user. The mounting surface 50 may be constructed of hardened plastic, metal or any other suitable material capable of withstanding the shock of the blows to the punching bag 40. The mounting surface 50 may be attached to the first 20 and second 30 brackets by screws or and other securement means.

Each strap 70 includes a first end 72 attached to a side wall 14 of the base 10 and an opposite second end (not shown) attached to a side wall 14 of the base 10 opposite the side wall 14 to which the first end 72 of the strap 70 is attached. Each strap 70 is structured and disposed to snugly wrap around the structure 80, thereby securing the base 10 to the structure 80. The straps 70 are preferably disposed to extend downward from the side walls 14 of the base and wrap around the bottom of the structure 80, but may, alternatively, be disposed to extend across the side walls 14 and wrap around the structure 80.

Figure 2:
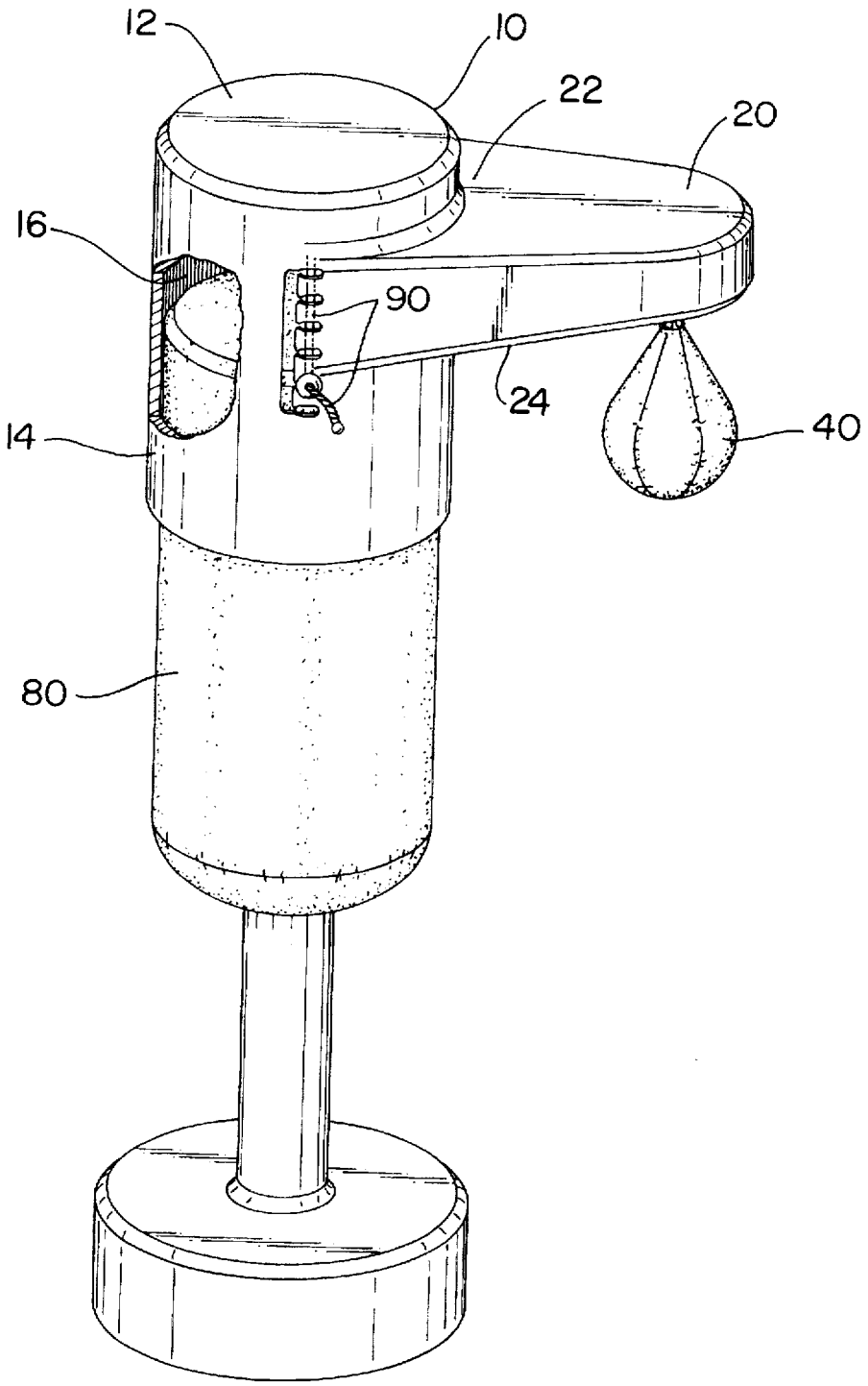
FIG. 2 is a side view of the present invention in partial section showing the base mounted on a boxing heavy bag with the adjustment cord raising the base.
Figure 3:
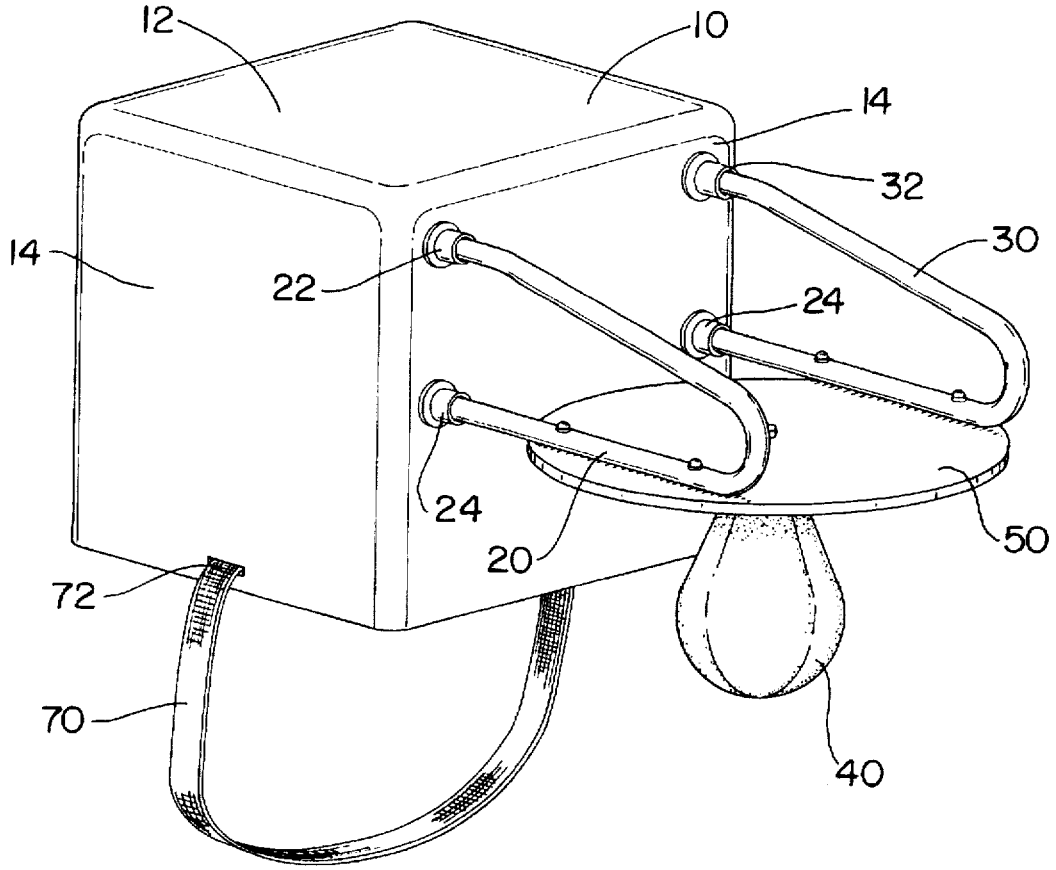
FIG. 3 is a front perspective view of the present invention showing the support brackets mounted to a side wall of the base and the mounting surface secured to the support brackets.

As shown in FIG. 2, the apparatus may also be adjusted to accommodate boxers of different heights by including a cord 90 attached to opposite side walls 14 of the base 10 and stretching across the chamber 16. The cord 90 is structured and disposed to prevent the structure 80 from being fully inserted into the chamber 16, thereby raising the base 10 and the attached punching bag 40. The cord 90 may be loosened or tightened to lower or raise the base 10 and attached punching bag 40 to accommodate boxers of different heights.

Figure 4:
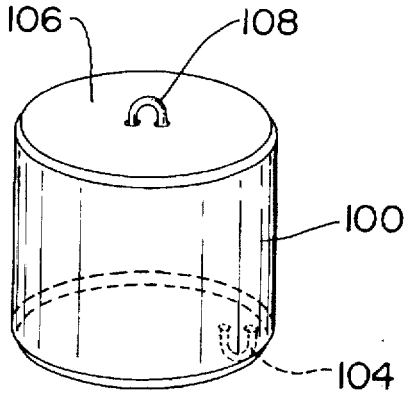
FIG. 4 is a front perspective view of the cup-shaped member of the skewing means showing the non-skewed attachment means centrally disposed on the bottom face.
Figure 5:
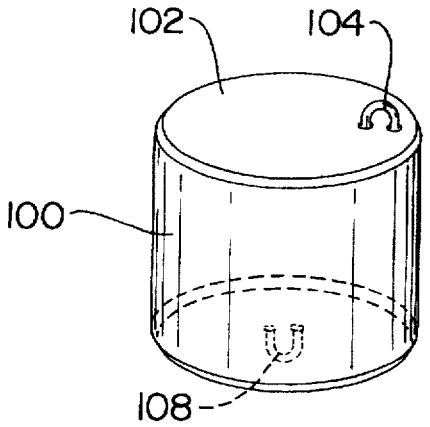
FIG. 5 is a front perspective view of the cup-shaped member of the skewing means showing the skewed attachment means disposed off-center on the top face.

The apparatus may also include means for skewing the punching bag 40 so that the punching bag 40 will respond in an unpredictable manner upon being struck by a user. As shown in FIGS. 4 and 5, the skewing means includes a generally cup-shaped member 100 having a top face 102 with a hook 104 secured thereto at an off-center location and an opposite bottom face 106 with a hook 108 centrally secured thereto. Attaching the off-center hook 104 on the top face 102 to the mounting surface 50 and the punching bag 40 to the centered hook 108 on the bottom face 106 causes the cup-shaped member 100 to hang from the mounting surface 50 in a skewed manner. Thus, the punching bag 40 will respond in an unpredictable manner upon being struck by a user. On the other hand, attaching the centered hook 108 on the bottom face 106 to the mounting surface 50 and the punching bag 40 to the off-centered hook 104 on the top face 102 causes the cup-shaped member 100 to hang from the mounting surface 50 in perpendicular relation thereto. Thus, the punching bag 40 will respond in a predictable manner upon being struck by a user. Accordingly, a user may choose to have the punching bag 40 respond in either a predictable or unpredictable manner by merely reversing the cup-shaped member 100.

Various changes may be made within the spirit and scope of the invention as described above.

What is claimed is:

1. A portable and adjustable boxing speed bag apparatus comprising:

a hollow base having a top wall and surrounding side walls, said top wall and said side walls defining a chamber, said chamber being sized to fit over and accept a structure therein, a first and second generally U-shaped support bracket, said first and second brackets each having a first end and an opposite second end, said first and second ends of said first and second brackets being mounted to said side walls of said base so that said first and second ends of said first bracket are aligned in generally vertical relation with each other, said first and second ends of said second bracket are aligned in generally vertical relation with each other and said second ends of said first and second brackets are aligned in generally horizontal relation with each other;

a punching bag;

a generally flat mounting surface secured to said first and second brackets so that said mounting surface lies in a generally horizontal orientation when said structure is seated within said chamber; and means for securing said punching bag to said mounting surface.

2. A portable and adjustable boxing speed bag apparatus as recited in claim 1 wherein said structure is a floor standing boxing heavy bag.

3. A portable and adjustable boxing speed bag apparatus as recited in claim 1 wherein said means for securing said punching bag to said mounting surface comprises a generally S-shaped hook having an upper end zone attached to said mounting surface and an opposite lower end zone attached to said punching bag.

4. A portable and adjustable boxing speed bag apparatus as recited in claim 1 further comprising means for securing said base to said structure.

5. A portable and adjustable boxing speed bag apparatus as recited in claim 4 wherein said means for securing said base to said structure comprises at least one strap, each of said straps having a first end attached to said side wall of said base and an opposite second end attached to said side wall of said base opposite said side wall to which said first end of said strap is attached, each of said straps being structured and disposed to snugly wrap around said structure.

6. A portable and adjustable boxing speed bag apparatus as recited in claim 1 further comprising means for adjusting the height of said punching bag.

7. A portable and adjustable boxing speed bag apparatus as recited in claim 6 wherein said means for adjusting the height of said punching bag comprises a cord attached to opposite side walls of said base and stretching across said chamber of said base, said cord being structured and disposed to prevent said structure from being fully inserted into said chamber, thereby raising said base and said attached punching bag.

8. A portable and adjustable boxing speed bag apparatus as recited in claim 1 further comprising means for skewing said punching bag so that said punching bag will respond in an unpredictable manner upon being struck by a user.

9. A portable and adjustable boxing speed bag apparatus as recited in claim 8 wherein said means for skewing said punching bag comprises a generally cup-shaped member having a top face and an opposite bottom face, said top face having skewed attachment means disposed at an off-center location on said top face, said bottom face having non-skewed attachment means disposed centrally on said bottom face, whereby attachment of said skewed attachment means to said mounting surface and said punching bag to said non-skewed attachment means causes said punching bag to respond in an unpredictable manner upon being struck by a user, and whereby attachment of said non-skewed attachment means to said mounting surface and said punching bag to said skewed attachment means causes said punching bag to respond in a predictable manner upon being struck by a user.

10. A portable and adjustable boxing speed bag apparatus comprising:

a hollow base having a top wall and surrounding side walls, said top wall and said side walls defining a chamber, said chamber being sized to fit over and accept a structure therein;

a first and second generally U-shaped support bracket, said first and second brackets each having a first end and an opposite second end, said first and second ends of said first and second brackets being mounted to said side walls of said base so that said first and second ends of said first bracket are aligned in generally vertical relation with each other, said first and second ends of said second bracket are aligned in generally vertical relation with each other and said second ends of said first and second brackets are aligned in generally horizontal relation with each other;

a punching bag;

a generally flat mounting surface secured to said first and second brackets so that said mounting surface lies in a generally horizontal orientation when said structure is seated within said chamber;

a generally S-shaped hook having an upper end zone attached to said mounting surface and an opposite lower end zone attached to said punching bag;

means for securing said base to said structure; and means for adjusting the height of said punching bag.

11. A portable and adjustable boxing speed bag apparatus as recited in claim 10 wherein said structure is a boxing heavy bag.

12. A portable and adjustable boxing speed bag apparatus as recited in claim 10 wherein said means for securing said base to said structure comprises at least one strap, each of said straps having a first end attached to said side wall of said base and an opposite second end attached to said side wall of said base opposite said side wall to which said first end of said strap is attached, each of said straps being structured and disposed to snugly wrap around said structure.

13. A portable and adjustable boxing speed bag apparatus as recited in claim 10 wherein said means for adjusting the height of said punching bag comprises a cord attached to opposite side walls of said base and stretching across said chamber of said base, said cord being structured and disposed to prevent said structure from being fully inserted into said chamber, thereby raising said base and said attached punching bag.

14. A portable and adjustable boxing speed bag apparatus as recited in claim 10 further comprising means for skewing said punching bag so that said punching bag will respond to in an unpredictable manner upon being struck by a user.

15. A portable and adjustable boxing speed bag apparatus as recited in claim 14 wherein said means for skewing said punching bag comprises a generally cup-shaped member having a top face and an opposite bottom face, said top face having skewed attachment means disposed at an off-center location on said top face, said bottom face having non-skewed attachment means disposed centrally on said bottom face, whereby attachment of said skewed attachment means to said mounting surface and said punching bag to said non-skewed attachment means causes said punching bag to respond in an unpredictable manner upon being struck by a user, and whereby attachment of said non-skewed attachment means to said mounting surface and said punching bag to said skewed attachment means causes said punching bag to respond in a predictable manner upon being struck by a user.

16. A portable and adjustable boxing speed bag apparatus comprising:

a hollow base having a top wall and surrounding side walls, said top wall and said side walls defining a chamber, said chamber being sized to fit over and accept a structure therein;

a first and second generally U-shaped support bracket, said first and second brackets each having a first end and an opposite second end, said first and second ends of said first and second brackets being mounted to said side walls of said base so that said first and second ends of said first bracket are aligned in generally vertical relation with each other, said first and second ends of said second bracket are aligned in generally vertical relation with each other;

a punching bag;

a generally flat mounting surface secured to said first and second brackets so that said mounting surface lies in a generally horizontal orientation when said structure is seated within said chamber;

a generally S-shaped hook having an upper end zone attached to said mounting surface and an opposite lower end zone attached to said punching bag;

at least one strap having a first end attached to said side wall of said base and an opposite second end attached to said side wall of said base opposite said side wall to which said first end of said strap is attached, each of said straps being structured and disposed to snugly wrap around said structure, thereby securing said base to said structure; and a cord attached to opposite side walls of said base and stretching across said chamber of said base, said cord being structured and disposed to prevent said structure from being fully inserted into said chamber, thereby raising said base and said attached punching bag.

17. A portable and adjustable boxing speed bag apparatus as recited in claim 16 wherein said structure is a boxing heavy bag.

18. A portable and adjustable boxing speed bag apparatus as recited in claim 16 further comprising means for skewing said punching bag so that said punching bag will respond to in an unpredictable manner upon being struck by a user.

19. A portable and adjustable boxing speed bag apparatus as recited in claim 18 wherein said means for skewing said punching bag comprises a generally cup-shaped member having a top face and an opposite bottom face, said top face having skewed attachment means disposed at an off-center location on said top face, said bottom face having non-skewed attachment means disposed centrally on said bottom face, whereby attachment of said skewed attachment means to said mounting surface and said punching bag to said non-skewed attachment means causes said punching bag to respond in an unpredictable manner upon being struck by a user, and whereby attachment of said non-skewed attachment means to said mounting surface and said punching bag to said skewed attachment means causes said punching bag to respond in a predictable manner upon being struck by a user.

* * * * *